US005080359A

United States Patent [19]

Thill

[11] Patent Number: 5,080,359

[45] Date of Patent: Jan. 14, 1992

[54] ILLUMINATED BALL

[75] Inventor: Gerald D. Thill, Minneapolis, Minn.

[73] Assignee: Spearhead Industries, Inc., Eden Prairie, Minn.

[21] Appl. No.: 650,186

[22] Filed: Feb. 4, 1991

[51] Int. Cl.[5] ..... A63H 33/22; A63H 17/28; A63B 43/06

[52] U.S. Cl. ..... 273/60 B; 273/65 EE; 273/65 EF; 273/DIG. 24; 446/438; 446/219

[58] Field of Search ..... 273/DIG. 24, 58 G, 65 E, 273/65 EC, 65 ED, 65 EE, 58 B, 58 BA, 58 F, 58 K; 446/219, 484, 485, 438, 439

[56] References Cited

U.S. PATENT DOCUMENTS 4,015,111 3/1977 Spector ..... 273/DIG. 24
4,479,649 10/1984 Newcomb et al. ..... 273/DIG. 24
4,963,117 10/1990 Gualdoni ..... 446/219

*Primary Examiner*—George J. Marlo

[57] ABSTRACT

A toy ball formed of a single, thin skin and being of light passing material having a source of chemilluminescent light retained therein. The chemilluminescent element is activated prior to insertion or placement into the ball and the element is either positively retained within a structural element integral to surface of the ball or is allowed to lie loosely within the ball. Such a light increases the play effect and useability of the ball during twilight or night hours. For positive placement of the element, the skin is cut to form a door which remains hinged at the uncut portion and normally urged closure of the door results in a holding force applied to the element. Several skin cuts will result in several doors which interact to retain the element.

6 Claims, 1 Drawing Sheet

ILLUMINATED BALL

FIELD OF THE INVENTION

This invention relates generally to a single skinned light transmitting ball of selected shape which is arranged and constructed to have a chemilluminescent light source placed loosely or retained interiorally therein.

SHORT SUMMARY OF THE INVENTION

A ball in various shapes such as a baseball or a football which is formed of a hollow single and thin skin generally resilient material into which a chemilluminescent light source element is placed after actuation thereof to illuminate the interior and thus through the light transmitting skin, exterior surface of the ball. The ball of the invention obviously may be of a round shape or may be of any desired shape depending upon the game that is being played and this would include round, out of round and footballs which are spheroidal in shape and more precisely an oblate spheroid shape.

Through the molding technique various characteristics such as the seams of a baseball, basketball or football would be molded into the material of which the ball is formed. This of course would give the toy a proper simulated aspect.

The method of inserting the light element into the ball when the same is freely moveable within the unit is simply a resilient flap formed into the outer skin with the flap normally biased back into surface alignment position. The resilient material will allow such a flap to be formed which will accommodate a number of flexing movements prior to any fracture thereof. When utilized in this manner of course the light element is free to move within the body but the element is of such minimal weight that it will not affect the play aspects of the ball and when, for example, the toy is in the form of a football normal centrifugal force will move the light source against the interior wall to produce only a minimal wobbling effect. Obviously in this form of the invention removal of the source after it is exhausted is accommodated simply by sizing of the insert opening which will allow, admittedly with effort, removal of the expended capsule.

A simple means of retention for the light source is provided by simply cutting or forming the skin into a number of flaps which will, after extension, tend to return to surface alignment and will trap the light source housing between the flaps. Obviously many forms of such a flap are available where at least two flaps will coact against the inserted element. Also, in this case, at least a portion of the housing must extend at least to the surface of the toy and this will allow easy removal after exhaustion. Again, the lightweight unit will not and does not affect the functions of the ball during use.

BACKGROUND AND OBJECTS OF THE INVENTION

The applicant has considered various commercially available lit balls and finds no patented products on the market. In a search of the patented prior art the applicant has found six patents which offer pertinency to the field of examination. These patents include a patent to Adams, U.S. Pat. No. 1,641,144; Blaemy, Jr., U.S. Pat. No. 2,776,139; Newcom, U.S. Pat. No. 4,479,649; Newcom, U.S. Pat. No. 4,695,055; Pennisi, U.S. Pat. No. 4,717,158; and Newcom, U.S. Pat. No. 4,930,776.

The patents to Blaemy and Adams do not disclose sources of light housed within the ball but do present single surfaced molded balls.

The patent to Pennisi includes a single surface ball with a plurality of light holes with light emitting particles or pellets contained therein. This reference also indicates that a light stick may be placed in the ball.

The patent to Newcom, U.S. Pat. No. 4,695,055 provides a diametrically arranged hole for receiving a light stick but this ball is not hollow.

The patent to Newcom, U.S. Pat. No. 4,479,649 includes a play ball of translucent material with a light stick but in this case the ball is inflatable rather than being of a preformed or molded shape.

The last patent to Newcom, U.S. Pat. No. 4,930,776 provides a WIFFLE BALL (Trademark) which houses a light stick but in this device the light stick is housed in a light ring which is frictionally held to the interior of the ball and the ring is inserted into the ball through one of the various apertures normally found on a WIFFLE BALL.

Applicant has considered these various structures and believes that the techniques he utilizes for insertion and retention of the light sources in his balls substantially reduces the comparable cost of the resulting device and has found that the added weight of the light source element does not substantially interfere with the play aspect of the unit.

It is therefore an object of the applicant's invention to provide a toy ball of any of several characteristics and known shapes which is hollow and has a transparent or light transmitting skin such that a chemical light source inserted or retained therein will transmit light through the skin of the ball to increase play effect.

It is a further object of the applicant's invention to provide a toy ball of single skin construction whereby an opening therethrough provided with a resilient door member will allow placement of a chemilluminescent light source into the hollow interior of the ball and similarly allow removal thereof after exhaustion of the light source with the flap or hinge or door element of the ball being normally aligned with the adjacent surface of the ball.

It is still a further object of the applicant's invention to provide a toy ball of a single skin hollow construction wherein retaining flaps are provided directly in the skin surface of the ball and the flaps will coact against the housing of a chemillulminescent light source placed therein while holding the light source in substantial alignment with the adjacent surface of the ball.

These and other objects and advantages of the applicant's invention will more fully appear from a consideration of the accompanying drawings and description.

DESCRIPTION OF THE INVENTION

In accordance with the accompanying drawings applicant's invention is illustrated in two forms which both allow for the introduction of a chemilluminescent light source into the interior of a hollow toy ball.

Figure 1:
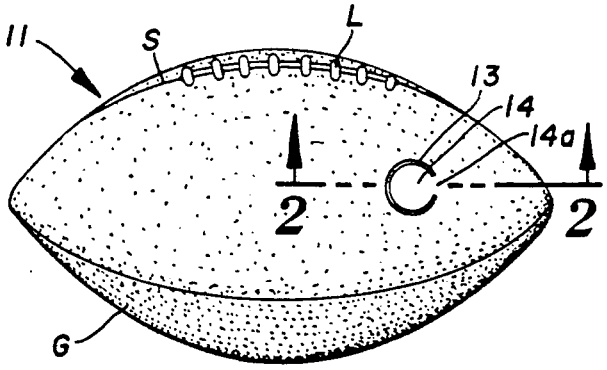
FIG. 1 is a first form of the invention wherein the applicant's invention is adapted to a football.
Figure 2:
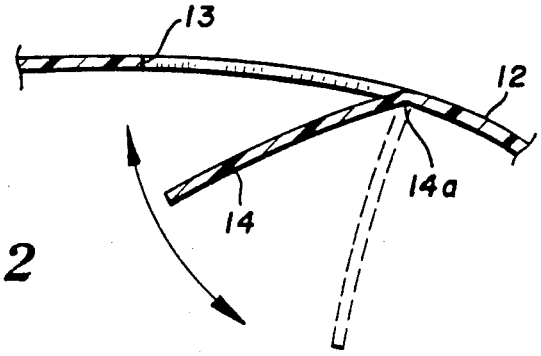
FIG. 2 is a section taken substantially along line 2—2 of FIG. 1.

In the first form of the invention as illustrated in FIGS. 1 and 2 the ball is other than round and simulates a football.

Figure 3:
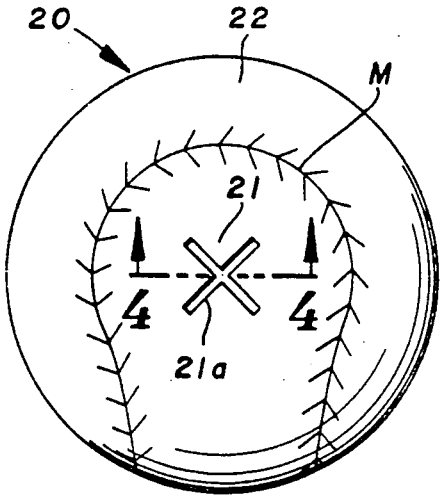
FIG. 3 is a second form of the invention wherein the invention is illustrated adapted to a simulated toy baseball; and, FIG. 4 is a section taken substantially along line 4—4 of FIG. 3 and particularly illustrating a chemilluminescent light source element held in position within the simulated toy.
Figure 4:
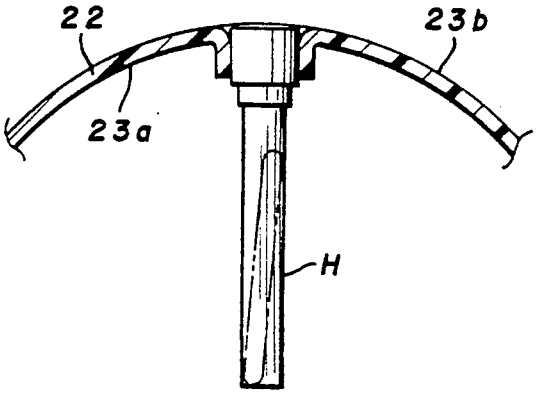

In the illustrations of FIGS. 3 and 4 the ball is round, and simulates a baseball or other, normal, round ball.

It should be obvious that other than round balls would be within the scope of the inventive concepts of the applicant.

As illustrated in FIGS. 1 and 2 the ball is designed, in one form, to receive a chemilluminescent light source interiorly thereof without otherwise retaining the source. Obviously this allows free movement of the source within the ball but the applicant has found, as the weight of the light source is relatively small, even in comparison to a hollow ball, that the effect of its movement interiorly the ball will not appreciably affect the normal play effect of the ball. Obviously in the case of a football the football would be spun during passing or throwing from one person to another and this force in itself would create a centrifugal force which would normally bring the light source against an interior surface of the ball.

The football a illustrated in FIG. 1 is generally designated 11 and is a hollow member formed by processes such as rotational molding which results in the single, thin skinned 12 unit. As also illustrated in FIG. 1 the exterior surface of a toy football 11 may include graining G, seams S, and laces L molded directly therein and the material may be colored or toned while still being light transmissive. The means for introducing the light source into the interior of the football 11 is particularly illustrated in FIG. 2 with an opening designated 13 and a door or flap thereto designated 14. The arrow of FIG. 2 illustrates the motion of door 14 to allow placement of a light source housing into the ball 11.

The methods for cutting a door 14 into the surface 12 of the football 11 are well known in the art and the door 14 will normally be hinged as at 14*a*. Due to the material utilized for such a ball, the door-hinge structure is commonly known as a living hinge. It should also be obvious that this hinged door 14 can physically contact a light housing H (a typical light housing H illustrated in FIG. 4) and hold the same in position adjacent the wall of a football rather than to allow the same to drop into the housing. Obviously an interference fit to the pattern in which the door is cut and the resilience and hinged effect of the door would allow such housing entrapment.

If the light source H is inserted completely into the football or other ball through the hinged door arrangement it does present certain difficulties on retrieval for replacement but applicant has found that this is not of a particularly negative consideration.

As illustrated in FIGS. 3 and 4 the ball 20 now appears in a round shape such as a baseball and seams M or the like are formed directly into the exterior surface of the ball 20. Obviously other decorative techniques can be utilized as in the football, to provide leather graining and seams so that the toy more closely represents a baseball.

As illustrated in FIG. 3 a plurality of door elements are located, as at 21, to disrupt the normal surface 22 of the ball 20 and cuts 21*a* result in a series of leaves or resilient door members as designated by the indicia 23*a*–23*b* of FIG. 4. This door cut arrangement then again provides a living hinge. The number of such leaves can be modified to any desired number with the end result obviously being the provision of a set of deformable leaves which will bend inwardly to allow a light source housing H to be inserted therein and be trapped by such leaf ends as they are biased into their normal surface alignment position.

As illustrated in FIG. 4 the housing H will be inserted into the ball 20 a distance such that its outermost end will be in substantial alignment and conformity to the surface 22 of the ball and the respective tips of the leaves 23*a*–23*b* will abut with the housing H to trap or lock the same into its inserted position. Obviously removal of the housing is gained by simply exerting sufficient force on the unit H to again re-deform the leaves 23*a*–23*b*.

The chemilluminescent housing is well known in the art and basically consists of a liquid containing housing with a breakable or rupturable container therein which through bending of the outer housing will rupture the interior capsule and cause intermix of the two chemicals for the production of light.

As stated, the interior of the toy housing is smooth and the qualities thereof promote reflection such that light is cast entirely interiorly of the unit and therefore will be transmitted substantially spherically therethrough for benefit of the user.

The material selected for the toy article and the thickness thereof is obviously chosen for its intended use. Both the football and baseball illustrated are used in relatively physical action activities and therefore the material and skin thickness will be such as to prevent denting, collapse or other shape deformation. Though the material will preferably be resilient, it will, when so formed, provide a substantially rigid unit.

It should be obvious that applicant has provided a new and unique method for placement of a chemilluminescent light source into play articles such as balls with a very simplified method of retaining the unit either in moveable or immovable position within the ball which does not rely upon particular forming techniques and simply relies upon resiliency and proper cutting of the outer surface of the ball to define integral bendable or hinged closure sections which will, when forces are removed therefrom return to conformity and alignment with the respective outer surfaces of the ball.

What is claimed is:

1. A toy ball providing a generally curved surface entirely thereover constructed to receive a source of illumination interiorally thereof to increase the useability and toy effect thereof, said ball including:

a. a hollow, thin shelled, generally rigid and resilient plastic body having the desired ball shape;

b. a door forming opening provided through said body to define at least a single door and providing a living hinge connection of said defined door to said body; and, c. said formed door being shiftable from the normal curved surface of the body to permit shifting thereof to allow insertion of a light source into said body and being normally biased to be in curved conformance to the body surface.

2. The toy ball as set forth in claim 1 and said door forming opening defining at least a pair of doors connected through a living hinge to said body, said doors being normally biased through said living hinge into alignment with the curved surface of said body.

3. The toy ball as set forth in claim 2 and said formed doors being arranged and constructed to retain a light source between themselves to frictionally position the light source interiorally of said body.

4. The toy ball as set forth in claim 1 and said door opening defining a plurality of doors, said doors being normally biased into conformance with the curved surface of said body.

5. The toy ball as set forth in claim 4 and said formed doors being arranged and constructed to frictionally retain a light source between themselves to position the light source interiorally of said body.

6. The toy ball as set forth in claim 1 wherein the light source includes a chemiluminescent member.

* * * * *